US007887106B2

(12) United States Patent
Jarolim

(10) Patent No.: US 7,887,106 B2
(45) Date of Patent: Feb. 15, 2011

(54) FLOOR LOCK

(75) Inventor: Reinhold Jarolim, Weyer (AT)

(73) Assignee: Knorr-Bremse Ges.m.b.H., Modling (AT)

( * ) Notice: Subject to any disclaimer, the term of this patent is extended or adjusted under 35 U.S.C. 154(b) by 264 days.

(21) Appl. No.: 11/662,932

(22) PCT Filed: Sep. 15, 2005

(86) PCT No.: PCT/EP2005/009919

§ 371 (c)(1),
(2), (4) Date: Sep. 21, 2007

(87) PCT Pub. No.: WO2006/029856

PCT Pub. Date: Mar. 23, 2006

(65) Prior Publication Data

US 2008/0191495 A1 Aug. 14, 2008

(30) Foreign Application Priority Data

Sep. 17, 2004 (AT) ..... A 1574/2004

(51) Int. Cl.
*E05C 5/00* (2006.01)

(52) U.S. Cl. ..... 292/66; 292/63; 292/DIG. 23; 292/216; 292/201

(58) Field of Classification Search ..... 292/66, 292/63, 216, 201, DIG. 23, 15, 23, 137–139, 292/145, 150, 302, 9; 296/155
See application file for complete search history.

(56) References Cited

U.S. PATENT DOCUMENTS

| | | | | |
|---|---|---|---|---|
| 4,947,964 | A * | 8/1990 | Husmann | 187/319 |
| 5,246,089 | A * | 9/1993 | Husmann et al. | 187/319 |
| 6,021,871 | A * | 2/2000 | Grabner | 187/335 |
| 6,142,540 | A * | 11/2000 | Girard et al. | 292/216 |
| 6,248,172 | B1 * | 6/2001 | Shirotani et al. | 118/500 |
| 6,386,621 | B1 * | 5/2002 | Kozak et al. | 296/155 |
| 7,370,731 | B2 * | 5/2008 | Cocher | 187/330 |
| 2003/0188488 | A1 | 10/2003 | Carlsson et al. | |
| 2008/0256871 | A1 * | 10/2008 | Bramauer | 49/339 |

FOREIGN PATENT DOCUMENTS

| | | |
|---|---|---|
| DE | 197 35 181 A1 | 2/1999 |
| EP | 0 359 640 A1 | 3/1990 |
| EP | 0 492 743 A1 | 7/1992 |
| EP | 0 875 434 A1 | 11/1998 |
| RU | 2 187 614 | 8/2002 |

* cited by examiner

*Primary Examiner*—Carlos Lugo
*Assistant Examiner*—Mark Willaims
(74) *Attorney, Agent, or Firm*—Barness Thornburg LLP

(57) ABSTRACT

A locking device for a swinging/sliding door for vehicles. The swinging/sliding door includes a door leaf having a guide rail along a bottom horizontal edge in a floor region. The swinging/sliding door is configured to be actuated by a door drive.

6 Claims, 2 Drawing Sheets

Fig 1
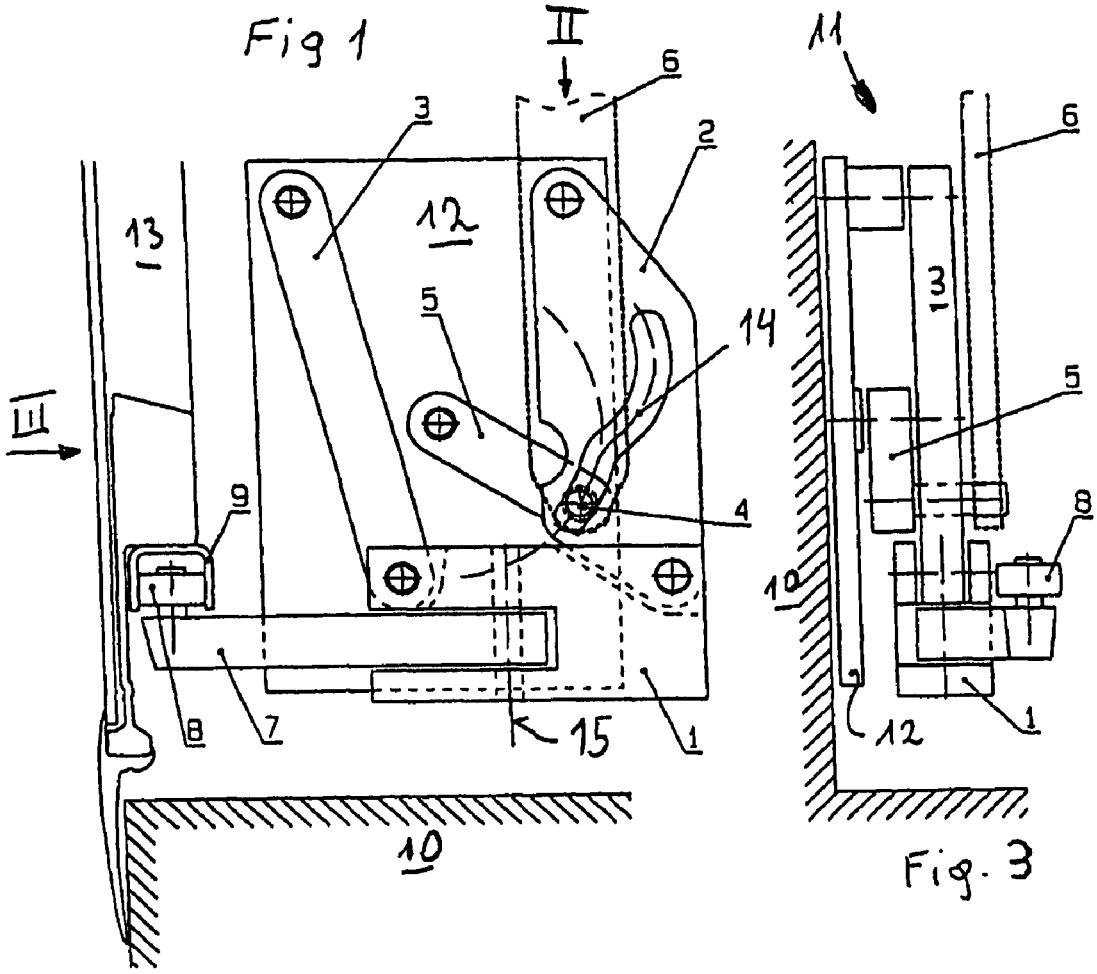
Fig. 3
Fig. 2
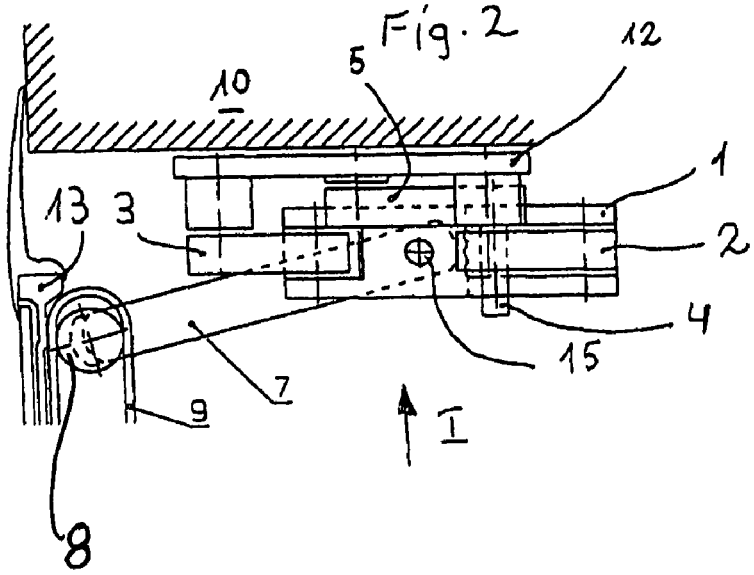

FLOOR LOCK

BACKGROUND AND SUMMARY

The present disclosure relates to a locking device for a swinging/sliding door. In particular, the present disclosure relates to a swinging/sliding door for vehicles. The locking device interacts with a guide rail arranged on the door leaf of the swinging/sliding door along the bottom horizontal edge thereof. The bottom horizontal edge is provided in the floor region, in the region of the secondary closing edge, and which can be actuated by a door drive.

Swinging/sliding doors, as are often used in particular in vehicles, for example in railroad cars or subway cars, are usually guided, and connected to the door drive, in the region of their top horizontal edge. The bottom door region is usually guided via guide rollers or guide rails or the like in order to prevent the door leaf from striking against the doorway or from rattling in the open state. There is then the problem of having to provide a closure means along the bottom peripheral region of the door leaf, in the region of the secondary closing edge, in the closed state, in order that reliable closure and sealing of the door is also ensured in this region. There are essentially two possible ways of providing for this in the prior art.

The first possibility provides a type of rotary lever or hook. The rotary lever or hook, once the door has reached the final closed position, is rotated such that it presses onto a latching surface of the door leaf in the closing direction and fixes the position of the door leaf in this way.

In the case of the second possibility, the guidance of the door leaf in the region of its bottom horizontal edge is used in order for the guide means interacting with the guide, at the end of the closing movement, to be moved in the direction normal to the door-leaf plane (or more or less normal to the door-leaf plane). This is done so that the correct final closed position can be ensured.

The first possibility has the disadvantage of requiring additional elements which have to be accommodated in the doorway. It thus involves high outlay and requires a considerable amount of space. In addition, special allowances have to be made in the door-control means.

The second possibility is easier to manage from the point of view of the control means, but the amount of space which it requires is precisely where the door users will be particularly aware of the space available. That is, in the inside width of the doorway.

The present disclosure relates to an improved device related to the second possibility mentioned above such that the amount of space required is reduced and that it is possible to have configurations in which a guide rail arranged on the door leaf may be of shorter design than has been the case hitherto. All of this is being done without increasing the costs or the installation outlay.

This present disclosure relates to a four-bar mechanism, such as a parallelogram, which is formed by an essentially horizontally arranged coupling member and levers arranged in an articulated manner thereon. One of the levers includes a guide slot into which projects a locking bolt. The locking bolt can be moved in the guide slot by an actuating element actuated by the door drive. This makes it possible for a rotary movement. Heretofore, movement ran in a horizontal plane and essentially transversely to the width of the doorway, and thus required a considerable amount of space in this direction. The movement can now be changed into a rotary movement about horizontally, or essentially horizontally, running axes.

The components involved are formed as flat structures, which thus have considerably reduced dimensions in the direction of the width of the doorway.

One embodiment, according to the present disclosure, includes a locking bolt that projects into the guide slot. The locking bolt is arranged on a locking lever, which lever can be pivoted about an essentially horizontal axis. The actuating element acts on the locking lever, for example, in the region of the bolt. This allows precise guidance of the locking bolt and of the actuating element using just one component, which cuts back on space and costs.

In an embodiment, according to the present disclosure, the coupling member has arranged on it a pivoting lever which can be pivoted about an essentially vertical axis and, at its free end, bears a guide roller which interacts with the guide. It is thus possible for the guide roller to be located within the width of the doorway when the door leaf is in the closed position, but right up against the periphery of the doorway, or slightly outside the width of the doorway, in the open position. As a result, the guide rail on the door leaf may be configured to be considerably shorter than the door leaf in this direction (width).

Other aspects of the present disclosure will become apparent from the following descriptions when considered in conjunction with the accompanying drawings.

BRIEF DESCRIPTION OF THE DRAWINGS

FIG. 1 shows a schematic view in a horizontal direction parallel to a door-leaf plane, as seen looking in direction I in FIG. 2, of a locking device in a closed and locked position, according to the present disclosure.

FIG. 2 shows a schematic plan view in a direction of arrow II in FIG. 1.

FIG. 3 shows a schematic view in a direction of arrow III in FIG. 1.

DETAILED DESCRIPTION

Figure 4:
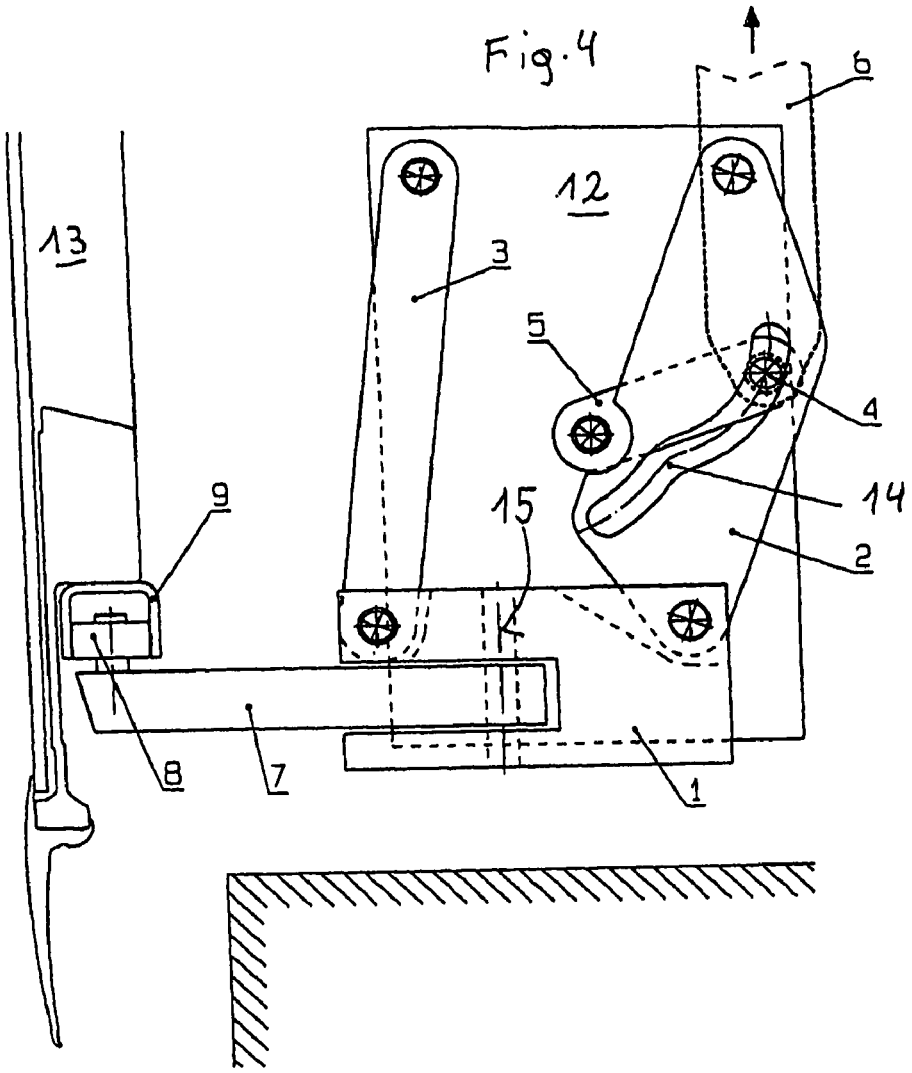
FIGS. 4 and 5 show views analogous to the views of FIGS. 1 and 2, respectively, the locking device being in the open position, according to the present disclosure.

FIG. 1 illustrates a schematic view of a retaining and locking mechanism or device, according to the present disclosure, as seen in a direction of arrow I in FIG. 2, running in a direction of a longitudinal axis of a vehicle. The retaining device 11 is installed in a car body or door frame 10 such that it is fastened on an installation plate 12. Two levers 2 and 3, connected by a coupling member 1, are mounted on the installation plate 12 in a manner of a four-bar mechanism, such as, in this embodiment, for example, a parallelogram. A pivoting lever 7 is mounted on the coupling member 1 such that it can be pivoted about an essentially vertically running axis 15. At an end region, which is directed toward a doorway opening and a door leaf 13, the pivoting lever 7 bears a guide roller 8, which interacts with a guide rail 9 of the door leaf 13.

One of the two levers 2 and 3, shown as lever 2 in the present embodiment, has a guide slot 14 into which projects a locking bolt 4, which is fastened on a locking lever 5 arranged in a pivotable manner on the installation plate 12. An actuating element 6 acts on the locking lever 5, as shown in FIG. 1. Actuating element 6 leads upward along a secondary closing edge of the vehicle and is actuated there by a door drive (not shown).

This device 11, functions as follows. Starting from a position shown in FIG. 1, the actuating element 6 is raised, which pivots the locking lever 5, and thus the locking bolt 4, upward along a circular path about a point of articulation of the locking lever 5. This movement gives rise to the displacement of the locking bolt 4 in the guide slot 14, which moves the coupling member 1 to the left, (as seen viewing FIG. 1) by way of the two levers 2, 3 being pivoted. The movement continues until an end position is reached, as shown in FIG. 4. The coupling member 1, and thus ultimately also the guide roller 8, executes a slight vertical movement. Such slight vertical movement may be of no consequence for the reliability and quality of guidance in the guide rail 9.

Figure 5:
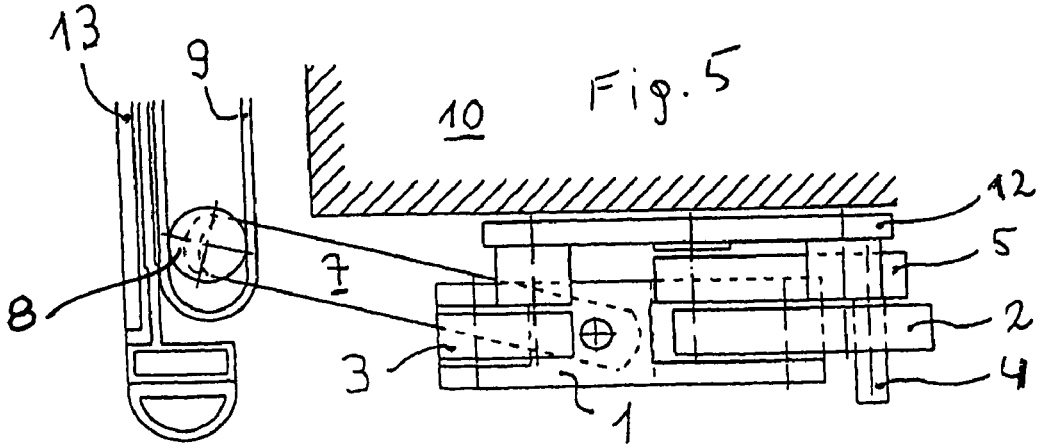

During an opening movement of the door, the pivoting lever 7 also moves about its axis 15, as seen by comparing FIGS. 2 and 5. From the closed position, as shown in FIG. 2, in which the pivoting lever 7 is directed into an interior of the width of the doorway, pivot lever 7 pivots and is carried along by the guide rail 9 of the opening door in a direction in which it is pivoted out of the width of the doorway, as shown in FIG. 5. As a result, a length of the guide rail 9 on the door leaf 13 may be considerably smaller than a length of an opening movement of the door leaf 13 Furthermore, the doorway width, when the door is open, is kept free of retaining and guiding parts of the door mechanism to a greater extent than was possible in the prior art.

In the embodiment as shown in the Figures, the guide slot 14 has a feature of being in a part of a circle arc in a portion in which the locking bolt 4 ends up being located when the door is in the closed position, as shown in FIG. 1, wherein a center point of the circle arc coincides with a pivot axis of the locking lever 5. This forms a dead region in the cinematics. This means that forces which act on the coupling member 1, and thus on the lever 2, in the opening direction via the door leaf 13, the guide rail 9, the guide roller 8, the pivoting lever 7 and the mounting thereof, are not capable of subjecting the locking lever 5 to a moment in the opening direction. This present locking or retaining mechanism or device 11 thus remains resistant to unintentional or malicious attempts to open the door in an unauthorized manner by shaking the door leaf 13.

This resistance could be achieved by a so-called over-dead-center mechanism, in which the shaping of the guide slot 14 in this region would have to be such that an opening movement on the door leaf 13 results in the locking lever 5 being pushed further in the locking direction. However, previously known over-dead-center mechanisms have the disadvantage that, in the absence of the customary door drive, when the door is being forced by the users, and then opened by the emergency opening device, the locking lever 5 has to be rotated out of its end region counter to the locking torque exerted by the passengers. That, in particular in situations which are unusual, unpleasant or dangerous, is difficult for passengers without training.

In comparison with what was just described, a guide slot 14 with a dead region like that shown herein, the forces which occur on the door leaf 13, with the exception of a negligible increase in the friction in the bearing of the locking lever 5, have no effect on the force which is required for opening the locking means or mechanism 11.

As shown in FIG. 4, which corresponds to the door being open, that region of the guide slot 14 in which the locking bolt 4 is located runs essentially in the direction in which the actuating element 6 is moved (see arrow II in FIG. 1 and the oppositely directed unnumbered arrow in FIG. 4). As a result, it is not necessary for the actuating element 6, or the displacement thereof, to be adjusted precisely since further movement of the actuating element 6 in the upward direction is no longer accompanied by any marked pivoting of the lever 2, or therefore by any marked change in the guide roller 8.

As can be seen in FIGS. 2 and 5, by way of metal plates, which run essentially parallel to one another, the device 11, according to the present disclosure, may be of very flat design. Such metal plates are easy to install in the doorway region and can be fitted at a distance from the floor itself, so that a risk of it becoming clogged with dirt or iced up is low.

An emergency release device, which is necessary for most doors of the type described herein, is within the scope of the present disclosure. When the door drive is moved manually, it automatically carries along the actuating element 6 in the region above the doorway, and no additional measures need therefore be taken.

Although the present disclosure has been described and illustrated in detail, it is to be clearly understood that this is done by way of illustration and example only and is not to be taken by way of limitation. The scope of the present disclosure is to be limited only by the terms of the appended claims.

I claim:

1. A locking device for a swinging/sliding door for vehicles, the swinging/sliding door including a door leaf having a guide rail along a bottom horizontal edge in a floor region, the swinging/sliding door being configured to be actuated by a door drive, and the locking device comprising:

a mechanism arranged in the form of a parallelogram, having a horizontally arranged coupling member and two levers, each lever having a first end pivotally mounted on an installation plate and further having a second end arranged in an articulated manner on the coupling member, a pivoting lever having an end coupled to the coupling member and an opposed free end of the pivoting lever coupled to the guide rail on the swing/sliding door, the parallelogram shape being maintained during an entire operation of the locking device from an unlocked position to a locked position of the locking device;

one of the levers including a guide slot into which projects a locking bolt, the locking bolt being movable in the guide slot by an actuating element actuated by the door drive when the door is moved between an opened and a closed position; and wherein the guide slot is shaped such that when the door is in the closed position, the locking bolt ends up located in a dead region of the guide slot such as to restrict movement of the locking bolt so as to lock the door in the closed position.

2. The locking device of claim 1, wherein the locking bolt is arranged on a locking lever pivotable about an essentially horizontal axis, and the actuating element acts on the locking lever in a region of the bolt.

3. The locking device of claim 1, wherein, the pivoting lever being pivotable about an essentially vertical axis and, at a free end of the pivoting lever, the pivoting lever bears a guide roller which interacts with the guide rail.

4. The locking device of claim 1, wherein the coupling member is continuously connected to the door leaf and movement of the coupling member moves the door leaf.

5. The locking device of claim 1, wherein movement of the mechanism from the unlocked position to the locked position moves the door leaf from the opened position to the closed position, respectively.

6. The locking device of claim 1, wherein the guide slot includes a circle arc and a center point of the circle arc coincides with a pivot axis of a locking lever forming the dead region.

* * * * *